US005775607A

United States Patent [19]

Bayliss et al.

[11] Patent Number: 5,775,607

[45] Date of Patent: Jul. 7, 1998

[54] HEAD ANTI-ROTATIONAL AND SEALING SYSTEM FOR A GYRATORY CRUSHER

[75] Inventors: John Andrew Bayliss, Crawley; James William Shannon, City Beach, both of Australia

[73] Assignee: Wescone Crushers Pty, Ltd., Australia

[21] Appl. No.: 793,158

[22] PCT Filed: Aug. 11, 1995

[86] PCT No.: PCT/AU95/00489

§ 371 Date: Feb. 11, 1997

§ 102(e) Date: Feb. 11, 1997

[87] PCT Pub. No.: WO96/04993

PCT Pub. Date: Feb. 22, 1996

[30] Foreign Application Priority Data

Aug. 12, 1994 [AU] Australia ..... PM7392

[51] Int. Cl.[6] ..... B02C 2/04

[52] U.S. Cl. ..... 241/207; 241/216

[58] Field of Search ..... 241/207, 216, 241/208, 209, 210, 211, 212, 213, 214, 215

[56] References Cited

U.S. PATENT DOCUMENTS

| | | | |
|---|---|---|---|
| 28,031 | 4/1860 | Wood | 241/212 |
| 180,620 | 8/1876 | Motte | 241/212 |
| 997,918 | 7/1911 | Jones | 241/212 |
| 1,549,555 | 8/1925 | Jorgensen . | |
| 2,327,384 | 8/1943 | Annesley | 241/216 X |
| 2,579,239 | 12/1951 | Lippmann | 241/215 |
| 2,787,424 | 4/1957 | Lippmann | 241/216 |
| 2,787,425 | 4/1957 | Gruender | 241/290 |
| 2,901,189 | 8/1959 | Conway | 241/207 |
| 2,972,448 | 2/1961 | Dorsey | 241/286 |
| 3,080,126 | 3/1963 | Kueneman et al. | 241/216 |
| 3,312,404 | 4/1967 | Allen | 241/215 |
| 3,565,353 | 2/1971 | Adam | 241/207 |
| 3,743,193 | 7/1973 | DeDiemar et al. | 241/207 |
| 3,744,728 | 7/1973 | Treppish | 241/207 |
| 3,750,967 | 8/1973 | DeDiemar et al. | 241/207 |
| 3,771,735 | 11/1973 | Decker et al. | 241/216 |
| 3,813,047 | 5/1974 | Torrence et al. | 241/211 |
| 3,837,585 | 9/1974 | Decker et al. | 241/213 |
| 3,873,037 | 3/1975 | Decker et al. | 241/211 |
| 3,957,213 | 5/1976 | Stockman et al. | 241/202 |
| 4,027,825 | 6/1977 | Coxhill | 241/213 |
| 4,034,922 | 7/1977 | Coxhill | 241/213 |

(List continued on next page.)

FOREIGN PATENT DOCUMENTS

| | | | |
|---|---|---|---|
| 618545 | 2/1989 | Australia | B02C 2/04 |
| 93069 | 11/1983 | European Pat. Off. | B02C 2/04 |

*Primary Examiner*—John M. Husar
*Attorney, Agent, or Firm*—Wolf, Greenfield & Sacks, P.C.

[57] ABSTRACT

The gyratory crusher includes a bowl which defines a chamber for receiving material to be crushed and a discharge opening at the base thereof through which crushed material is able to discharge. A crushing head is mounted in the bowl at an offset position with respect to a central axis of the bowl, and a drive assembly is operable for driving the crushing head within the bowl for imparting gyratory motion to the head about a gyratory axis inclined with respect to and intersecting the central axis, whereby frangible or friable material received into the chamber is subjected to crushing between an inner peripheral surface of the bowl and an outer peripheral surface of the head by the gyratory motion of the head. The crusher further includes a system for restraining rotation of the head relative to the bowl and the gyratory axis, including an annular resilient member disposed between an annular lower peripheral region of the head and an annular surface, of a fixed structure of the crusher, which is spaced from and substantially co-axial with the region; securing means for securing a first edge of the resilient member to one of the annular regions of the head and the fixed structure annular surface; an annular band of friction material around a second edge of the resilient member; and biasing means for urging the friction band into frictional contact with the other one of the annular region of the head and the fixed structure annular surface.

22 Claims, 3 Drawing Sheets

U.S. PATENT DOCUMENTS

| | | | |
|---|---|---|---|
| 4,037,800 | 7/1977 | Coxhill | 241/213 |
| 4,084,756 | 4/1978 | Coxhill | 241/213 |
| 4,192,472 | 3/1980 | Johnson | 241/215 |
| 4,198,003 | 4/1980 | Polzin et al. | 241/30 |
| 4,206,881 | 6/1980 | Werginz | 241/207 |
| 4,272,030 | 6/1981 | Afanasiev et al. | 241/37 |
| 4,316,585 | 2/1982 | Guzik | 241/211 |
| 4,339,087 | 7/1982 | Pollak | 241/211 |
| 4,351,490 | 9/1982 | Johnson | 241/286 |
| 4,391,414 | 7/1983 | Reiter | 241/213 |
| 4,410,143 | 10/1983 | Polinski | 241/209 |
| 4,478,373 | 10/1984 | Gieschen | 241/208 |
| 4,512,525 | 4/1985 | Cameron | 241/207 |
| 4,585,179 | 4/1986 | Tsuji et al. | 241/101.7 |
| 4,592,517 | 6/1986 | Zarogatsky et al. | 241/207 |
| 4,602,746 | 7/1986 | Stockmann et al. | 241/215 |
| 4,615,491 | 10/1986 | Batch et al. | 241/37 |
| 4,679,741 | 7/1987 | Hansen | 241/206 |
| 4,681,269 | 7/1987 | Arawaka | 241/101.2 |
| 4,787,563 | 11/1988 | Tanaka et al. | 241/208 |
| 4,844,362 | 7/1989 | Revnivtsev et al. | 241/210 |
| 4,892,257 | 1/1990 | Stoeckmann et al. | 241/32 |
| 4,895,311 | 1/1990 | Arawaka | 241/207 |
| 4,976,470 | 12/1990 | Arawaka | 241/212 |
| 5,035,368 | 7/1991 | Finley et al. | 241/212 |
| 5,115,991 | 5/1992 | Saari | 241/208 |
| 5,152,468 | 10/1992 | Virtamo et al. | 241/213 |
| 5,190,229 | 3/1993 | Kaiser | 241/207 |
| 5,312,053 | 5/1994 | Ganser, IV | 241/30 |
| 5,350,125 | 9/1994 | Clark | 241/208 |

HEAD ANTI-ROTATIONAL AND SEALING SYSTEM FOR A GYRATORY CRUSHER

FIELD OF THE INVENTION

The present invention relates to an improved system for preventing free rotation of the head or cone, of a gyratory crusher which also is able to provide sealing.

BACKGROUND OF THE INVENTION

The system of the present invention is particularly suited for use with a gyratory crusher of the type disclosed in Australian patent specification 618545 (AU-B-19935/88). However, while the system will be described in large part with reference to a crusher of that type, it is to be understood that the system also has application to other types of gyratory crushers.

Australian patent specification 618545 teaches in relation to its gyratory crusher that, in the absence of any resistive force being applied to the head of the crusher during revolution of the same about the central axis, the head may rotate relative to the bowl and to a shaft by which gyratory motion is imparted to the head. It is further stated that when frangible or friable material is deposited into the crushing chamber defined by the bowl, and is received within the confines of the annular nip between the bowl and head, the material will tend to resist rotation of the head relative to the bowl.

When there is no frangible or friable material present in the crushing chamber, the heads of most gyratory crushers rotate relative to the bowl if they are not restrained. The heads of crushers which are mounted on and supported by commercial ball and roller bearings often rotate at virtually the same speed as the drive shaft gyrates. Such rotation is undesirable, since:

1. The head rotating needlessly is an avoidable danger to operators.
2. The closest proximity of the crushing head to the bowl during operation of the crusher is called the closed side setting (CSS) and this determines the size of the resultant product (crushed material). The CSS is adjusted whenever necessary to maintain the size of the product within the desired limits. It is usual for the CSS to be audited by measurement periodically and in many crusher installations this is most conveniently done by lowering a soft deformable material such as lead, on a suspension wire, into the crushing chamber whilst the crusher is operating without feed. After it is crushed, the deformable material is withdrawn, by raising the suspension wire, and its thickness measured to determine the CSS. In other installations the deformable material can be dropped into the crushing chamber and recovered, for measurement, from below the crusher. However, when the head is rotating at approximately the speed of gyration such auditing procedures are impossible. It is far too dangerous to lower a suspended item into the chamber and in any case the rotation distorts the deformable material making accurate CSS measurement impossible.
3. If the head is rotating at approximately gyratory speed in an empty crushing chamber the entry of new feed material is impeded and chamber wear is excessive. Firstly the new material is ejected by the centrifugal force transferred from the head. Secondly the head and bowl suffer premature gouging wear by the new material as the rotational inertia (energy) of the head is absorbed. For these reasons the natural tendency of the head to rotate when the crusher is running with the crushing chamber empty is not acceptable to the industry. A head anti-rotation device is required.

Specific to its type of gyratory crusher, but also of relevance to others, Australian patent 618545 further teaches that, when a gyratory crusher is crushing frangible or friable material, there is often a slight circular inching of a point on the lower periphery of the head with respect to an adjacent point on the circumferential wall of the discharge opening in a clockwise or anti-clockwise direction during nutation (gyration) of the head. The circular inching (rotation) of the head cannot be resisted except by the application of a high restraining force, and it is not appropriate to restrain it because:

a) the force is high and an adequate restraining device must be large and expensive,
b) restraint will cause unnecessary gouging wear of the crushing head and bowl by the friable and frangible material, and
c) normal wear of the crushing head and bowl is likely to be uneven, causing wear channels in the bowl and head which allow oversize product to pass through the crusher and mix with correctly crushed product, such that close control of crushed product grade is impossible.

It follows that a desirable, crushing head anti-rotation device is required to apply adequate but minimal restraint to keep the head stationary, without rotation, when gyrating with the crushing chamber empty, and to permit slight rotation of the head relative to the bowl when crushing.

SUMMARY OF THE INVENTION

A gyratory crusher according to the invention includes a bowl defining a chamber for receiving material to be crushed, and further defining a discharge opening at the base thereof through which crushed material is able to discharge. The crusher also includes a crushing head mounted in the bowl at an offset position with respect to a central axis of the bowl, and a drive assembly for driving the crushing head within the bowl for imparting gyratory motion to the head about a gyratory axis inclined with respect to and intersecting the central axis. The arrangement is such that frangible or friable material received into the chamber is subjected to crushing between an inner peripheral surface of the bowl and an outer peripheral surface of the head by the gyratory motion of the head. The crusher further includes a system for restraining rotation of the head relative to the bowl and the gyratory axis, the system including:

(i) an annular resilient member disposed between an annular lower peripheral region of the head and an annular surface, of a fixed structure of the crusher, which is spaced from and substantially co-axial with said region;
(ii) securing means for securing a first edge of the resilient member to one of the annular region of the head and the annular surface of the fixed structure;
(iii) an annular band of friction material provided around a second edge of the resilient member; and
(iv) biasing means for urging the friction band into frictional contact with the other one of the annular region of the head and the annular surface of the fixed structure.

The biasing means is operable to provide a sufficient said frictional contact to restrain the head from rotating relative to the bowl and gyratory axis while the head is gyrating in the absence in the chamber of material to be crushed, while allowing the head to rotate relative to the bowl and gyratory axis, during a crushing operation, by slippage between the friction material and the other one of the annular region of the head and the annular surface of the fixed structure.

In a first embodiment, the securing means secures the first edge of the resilient member to the annular region of the head, with the biasing means urging the friction band into frictional contact with the annular surface of the fixed structure. The arrangement is such that, with any rotation of the head (relative to the bowl and the gyratory axis), the resilient member is rotatable with the head. Such rotation of the resilient member is permitted by slippage between the friction material and the fixed structure, but with the action of the biasing means tending to retard the rotation.

In a second embodiment, the securing means secures the first edge of the resilient member to the annular surface of the fixed structure, with the biasing means urging the friction band into frictional contact with the annular region of the head. The arrangement is such that, with any rotation of the head, the securing means is restrained against rotation with the head. The rotation is permitted by slippage between the friction material and the annular region of the head, but with the action of the biasing means again tending to retard the rotation.

The means for securing the first edge of the resilient member, in each of the first and second embodiments, may be in the form of an annular plate, or an annular series of arcuate plates. The plate, or series of plates may be secured in relation to the one of the head and fixed structure by means of bolts, screws, clips or the like so as to clamp the first edge securely to the head or fixed structure. In such case, the resilient member preferably defines a bead which engages with the plate, or series of plates, and/or with the one of the bead and fixed structure in a manner restraining the resilient member from being able to deform so as to pull away from the securing means. Alternatively, the securing means may be an overlapping pair of annular plates, or two overlapping annular series of arcuate plates, with the first edge gripped between the pair of plates, or between the two series of plates, and the resultant assembly secured in relation to the one of the head and the fixed structure, by bolts, screws, clips or the like. In a still further alternative, the securing means may comprise an annular plate, or series of arcuate plates, which is embedded in, or adhesively or heat sealingly bonded to, the first edge of the resilient member, with the resultant assemblage of the first edge and plate, or series of plates, being secured in relation to the one of the head and the fixed structure by bolts, screws, clips or the like.

The resilient member most preferably is imperforate. It may, for example, be made of neoprene or similar material, and preferably is reinforced such as with woven fabric. Where the resilient member is imperforate, it provides the added benefit of effecting a seal between the head and the fixed structure. However, the resilient member can be perforate, with a seal being provided by other means.

It is possible for the resilient member to be formed of a material which is suitable to function as the band of friction material required at its second edge. However, it is preferred that the resilient member and the band of friction material be of respective materials. In the latter case, the band may comprise any suitable material, such as that used as friction material in vehicle brakes. The friction band may be of continuous annular form, or comprise an annular series of arcuate sections.

When respective materials are used for the resilient member and the friction band, the second edge of the resilient member may be suitably bonded or heat sealed to the friction band. However, it is preferred that the friction band be part of an assembly comprising means for gripping the second edge of the resilient member and the friction band, with the friction band being secured to the gripping means. In the latter case, the gripping means may comprise at least one annular plate or series of arcuate plates such as described in relation to the securing means.

The biasing means may be mounted on the one of the annular region of the head and the annular surface of the fixed member to which the friction member is to be urged into frictional contact. Alternatively, the biasing means may be mounted between the annular region and the annular surface, and subject to expansion and compression as the head gyrates. In the first embodiment of the invention, it is preferred that the biasing means is mounted on the fixed structure. In the second embodiment, it is preferred that the biasing means is mounted between, and engages both of, the annular region and the annular surface.

The biasing means preferably comprises a plurality of compression springs disposed in an angularly spaced array. However, the biasing means can comprise a single spring of annular form, such as a spring of undulating annular form or a helical compression spring, which is substantially co-axial with the head and the annular surface of the fixed structure. Where of such annular form, the biasing means may be mounted between the band of friction material and a shoulder defined by the one of the head and the fixed structure to which the friction band is to be urged into frictional contact. Most preferably an annular pressure plate, or an annular series of arcuate pressure plates, is provided between the biasing means and the friction band, with bias applied by the biasing means being applied to the friction band through the pressure plate or series of plates.

BRIEF DESCRIPTION OF THE DRAWINGS

In order that the invention may more readily be understood, description now is directed to the accompanying drawings, in which.

DETAILED DESCRIPTION

Figure 1:
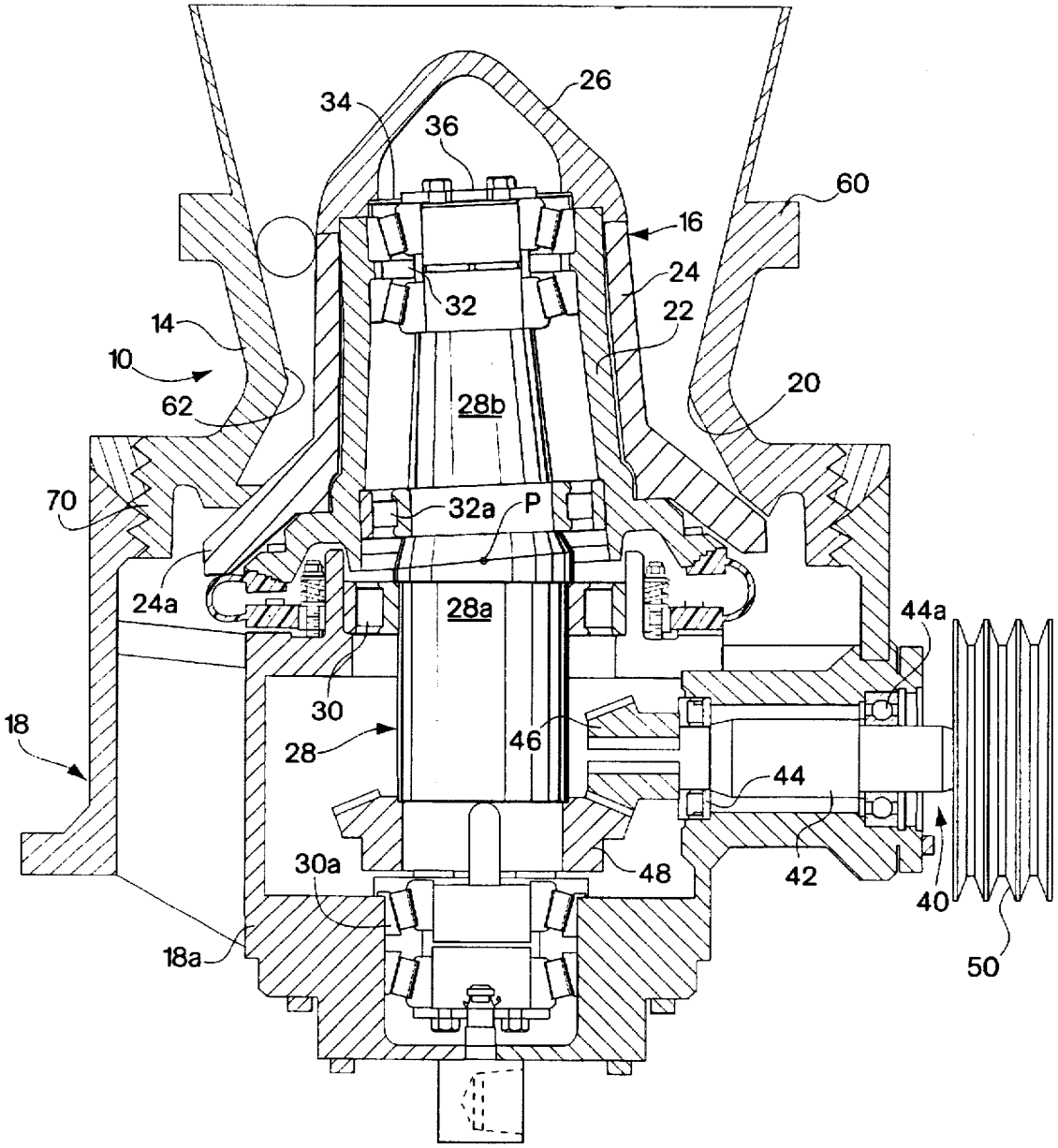
FIG. 1 is a sectional view of a gyratory crusher having an anti-rotation system according to a first embodiment of the invention.

FIG. 1 shows a gyratory crusher 10 which has an anti-rotation system 12. Much of the construction and operation of the crusher 10 readily will be understood. Accordingly only broad detail is provided in relation to features which are not directly concerned with the system 12.

The crusher 10 has a bowl 14 and a head 16. The bowl 14 is mounted on a fixed, bowl support frame 18. As shown the bowl 14 is of circular transverse cross-section, and converges frusto-conically from its open upper end to a constriction at 20, and thereafter diverges frusto conically to its open lower end.

The head 16 also is circular in transverse section and comprises an inner bearing housing 22 on which a head liner 24 is secured, and a head cap 26. The liner 24 diverges slightly from its upper end to a region below the construction 20, and thereafter flares downwardly and outwardly to provide a skirt portion **24*a***.

The crusher 10 includes an eccentric shaft 28 on which head 16 is rotatably mounted. The shaft 28 has a lower portion **28*a* which has an axis of rotation substantially co-incident with the axis of bowl 14. The shaft portion 28*a* is rotatable in an upper bearing assembly 30 and a lower bearing assembly 30*a*, with each of the assemblies 30 and 30*a* located in lower support frame 18*a* which can form part of the frame 18. The shaft 28 also has an upper portion 28*b*** which has an axis which is inclined with respect to the axis of the shaft portion 28a, with the respective axes of the shaft portions 28a and 28b intersecting at a fixed point P which is on or closely adjacent to a basal plane of the head 16. That is, point P is so located relative to a plane containing the lower peripheral extremity of the skirt portion 24a. Mounting of the head 16 on shaft 28 is by means of an upper bearing assembly 32 and a lower bearing assembly 32a, with each of the assemblies being concentric with and provided between the upper shaft portion 28b and the housing 22 of the head 16.

Below the head cap 26, the interior of the head 16 is protected by a top seal 34 and a retaining plate 36. At the base of head 16, the interior of the head 16 and of sub-frame 18a is protected by a resilient annular seal provided by anti-rotation system 12.

The shaft 28 is driven, so as to rotate on the axis of its lower shaft portion 28 by drive assembly 40, utilising a drive motor (not shown). The assembly 40 has a drive shaft 42 mounted in support frame 18a by inner bearing assembly 44 and outer bearing assembly 44a. A pinion 46 is mounted on the inner end of the shaft 42, and meshes with a crown wheel 48 secured around portion 28a of the shaft 28. A pulley 50 on the outer end of the drive shaft 42 enables the shaft 42 to be rotated by operation of the motor, via drive belts (not shown), for rotation of the shaft 28.

In operation of the crusher 10, the drive assembly 40 rotates the shaft 28 on the axis of its lower portion 28a. As the axis of the upper shaft portion 28b is inclined to the axis of lower shaft portion 28a, and as head 16 is co-axially mounted on portion 28b, rotation of the shaft 28 on the axis of its lower portion 23a causes head 16 to gyrate about the fixed point P. Moreover, as the lower end of head 16 is located proximate to, or coincident with point P, the gyratory motion of head 16 is such that movement of its upper end is predominantly transverse to the axis of bowl 14 and such that movement of the lower end of head 16 is substantially parallel to the axis of bowl 14.

Material to be crushed is fed into the upper end of bowl 14, to a crushing chamber 60 defined within the bowl 14 around the head 16. The movement of the head 16, during rotation of the shaft 28, provides a crushing action in which, where the gap between the crushing surface 62 of bowl 14 and head 16 is a minimum at the upper end of the chamber 60, as shown for a representation of a particle of material to be crushed at location A, the gap is:

- a maximum at the diametrically opposed side of the upper end of chamber 60;
- a maximum at the lower end of chamber 60, at the same side, i.e. directly below location A; and
- a minimum at the lower end of chamber 60, at the diametrically opposed side, i.e. at the location "B".

Furthermore, as shaft 28 rotates, the gyratory motion of head 16 causes the location of the upper maximum and minimum gap openings, and of the lower minimum and maximum gap openings, to be in successive diametrical planes of bowl 14. Thus, after rotation of shaft 28 through 1800 from the position shown in FIG. 1, there will be a maximum gap at each of locations A and B.

Figure 2:
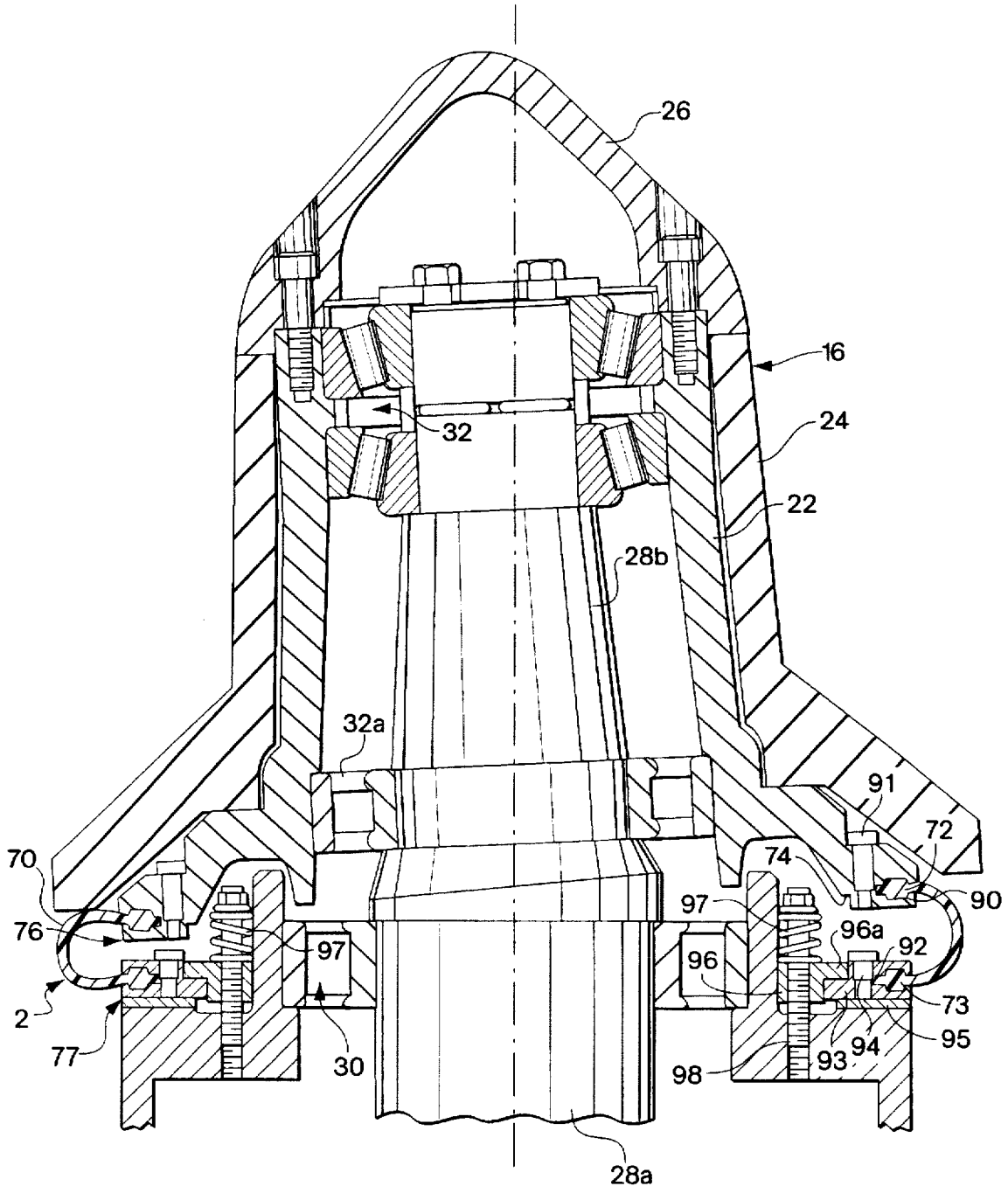
FIG. 2 is similar to FIG. 1, but shows detail of the anti-rotation system on an enlarged scale.

With further reference to FIG. 1 and in particular to FIG. 2, it will be noted that system 12 of the crusher 10 has an annular, resilient seal 70, which has upper and lower peripheral beads 72 and 73. Also, system 12 has an upper clamping assembly 76 which secures seal 70 in relation to surface 74 of the head 16, and a lower clamping assembly 77 which secures seal 70 in relation to support frame 18a.

Assembly 76 simply comprises an annular clamp plate 90 which is retained on head 16 by bolts 91. The upper surface of plate 90 is grooved (also is surface 74 of the head 16, if required), for locating bead 72 securely and sealingly against surface 74. Thus, with rotation of head 16, seal 70 is drawn by its bead 72 to rotate with head 16.

Clamping assembly 77 has upper and lower annular clamping plates 92 and 93, each grooved to locate bead 73. The plates 92 and 93 are secured together, to securely and sealingly hold bead 73, by bolts 94. Plate 92 has a larger internal diameter than plate 93, such that an inner margin of the top surface of plate 93 is thereby exposed. Also, bonded to the lower surface of plate 93 there is an annular friction lining 95 which engages surface 75 of support frame 18a.

System 12 further includes an annular biasing plate 96 which has a stepped lower surface to define a lip 96a. Plate 96 fits radially within clamping assembly 77, but with lip 96a resting on the exposed top surface of plate 93. Additionally, a plurality of circumferentially spaced springs 97 are provided to apply pressure to biasing plate 96. As shown, each spring 97 is secured in position, and compressed, by a respective bolt 98 which passes through a respective aperture in plate 96 and is threaded into support frame 18a.

Working of system 12 generally will be understood in the context of preceding description. As will be appreciated, friction lining 95 is positioned for frictional engagement with surface 75 of frame 18a such that, with any rotation of head 16, seal 70, each of assemblies 76 and 77 and, hence, lining 95 rotate with head 16. The springs 97 are arranged so that they compress lining 95 against surface 75, but without the need for the springs 97 to expand and compress as the head gyrates.

As upper bead 72 of seal 70 is clamped directly to surface 74 of the head 16, seal 70 is carried with head 16 in the event of slight circular inching of the latter.

The combined effect of all springs 97 is adequate to provide sufficient friction between lining 95 and the support frame 18a to prevent rotation of the head 16 when gyrating with the crushing chamber 60 empty. However, the friction does not prevent the head 16 creeping around as frangible and friable materials are crushed.

The seal 70 excludes dirt, water and chemical and retains the lubricants. It also prevents free rotation of the crushing head 16 by transferring the resistance generated at the friction surfaces of lining 95 and surface 75 to the crushing head 16.

Figure 3:
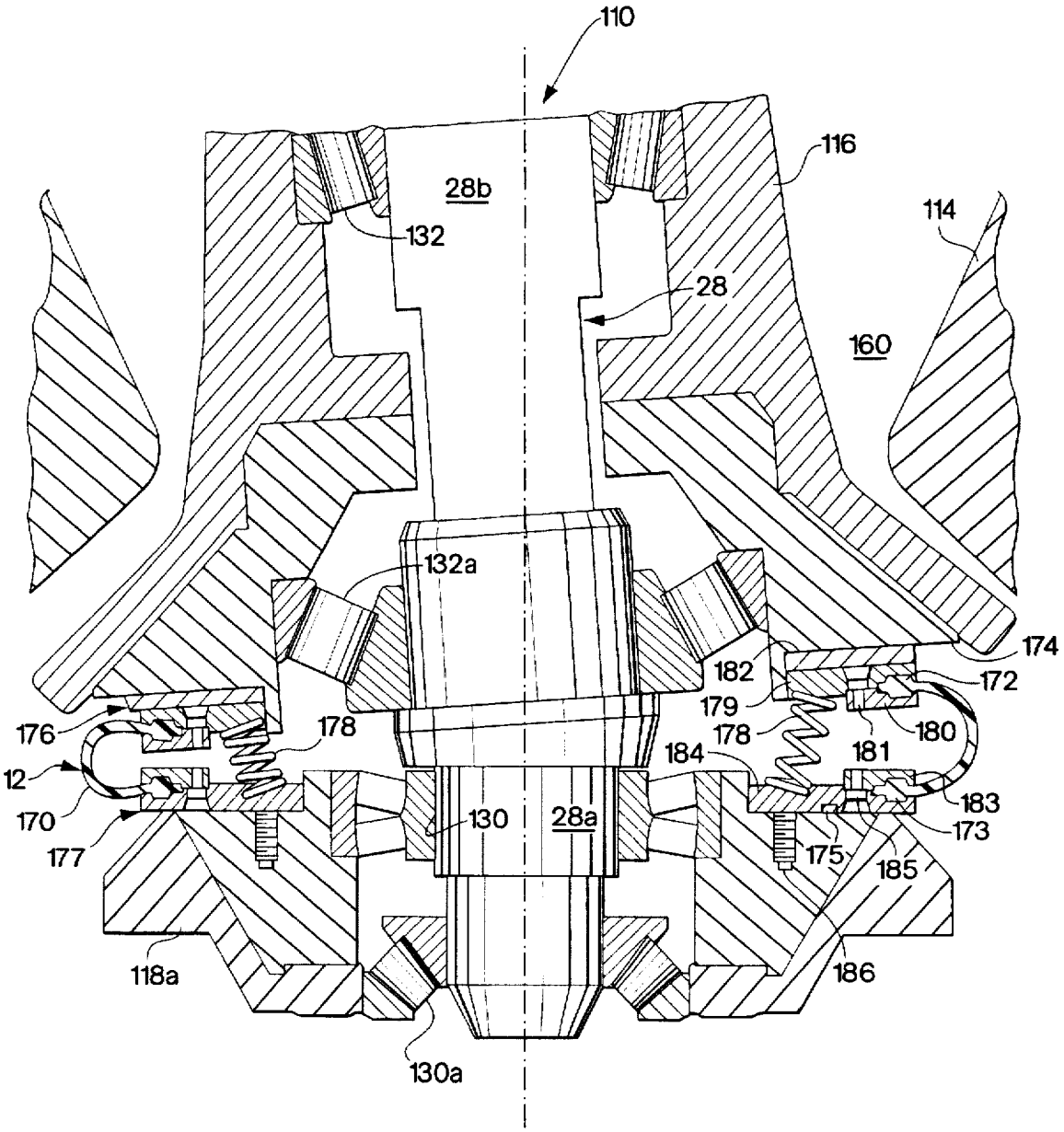
FIG. 3 is similar to FIG. 2, but illustrates second embodiment of an anti-rotation system according to the invention.

Turning now to FIG. 3, parts corresponding to those of the crusher 10 of FIGS. 1 and 2 have the same reference numeral, plus 100.

In crusher 110 of FIG. 3, system 112 has an annular resilient seal 170 which defines a bead 172 around its upper peripheral edge, and a bead 173 around its lower peripheral edge. The seal 170 is mounted in relation to basal surface 174 of the head 116 and surface 175 of the lower support frame 118a by means of an upper gripping assembly 176, a lower gripping assembly 177 and a plurality of circumferentially spaced springs 178 which are nested in and extend between the assemblies 176 and 177.

The upper assembly 176 has an upper clamping plate 179 and a lower clamping plate 180, each of annular form. Bead 172 of the resilient seal 170 is located in a respective groove of each of the plates 179 and 180, with the latter secured firmly together by screws 181 to retain bead 172. The plate 179 has a smaller internal diameter than the plate 180, to define an inner margin against which springs 178 engage. Bonded to the upper surface of the plate 179 there is an annular friction lining 182 which, under the bias of springs 178, frictionally engages the surface 174 of the head 116.

The lower assembly 177 has an upper clamping plate 183 and a lower clamping plate 184, each of annular form. The bead 173 of the seal 170 is located in a respective groove of each of the plates 183 and 184, with the latter secured together by screws 185 for retaining bead 173 therebetween. The plate 184 has a smaller internal diameter than the plate 183, to define an inner margin against which springs 178 engage. Also, the plate 184 is secured to the surface 175 of support frame 188*a* by screws 186, such that assembly 177 is secured against rotation.

In operation of the crusher 110, support frame 118*a* is stationary. However the head 116 is made to gyrate via the drive system 140. Frictional engagement of lining 182 with the surface 174 of the head 116 prevents rotation of the head 116 whilst chamber 160 is empty. However, that engagement is such as to permit slight rotation of the head 116 during crushing of material in chamber 160, by slipping of surface 174 over lining 182. As head 116 gyrates above the support frame 118*a*, the springs 178 expand and are compressed due to variation in the spacing between surface 174 of the head 116 and the surface 175 of the support frame 118*a*. The springs 178 also are such as to overcome inertia forces in the plates 179 and 180 of the assembly 176, in friction lining 182 and in seal 170, to provide a sufficient average force operable to keep lining 182 in firm contact with surface 174 to generate a level of friction sufficient to hold head 116 against rotation while chamber 160 is empty. The tendency for lining 182 and plates 179 and 180 to rotate with head 116 is resisted by seal 170 and the springs 178 although, in some cases, this resistance can be increased by a sprag mechanism with a sliding key.

The total effect is for the clamp plates 183 and 184 of the assembly 177 to remain stationary, and to clamp the bead 173 of seal 170 stationary. The springs 178 remain stationary at their lowest extremity, and they expand and contract to keep lining 182 in contact with surface 174. The plates 179 and 180 of assembly 176 clamp bead 172, and gyrate with the head 116, without rotating.

The seal 170 forms a complete flexible barrier between external parts of the crusher 110 and its internal driving mechanism, to exclude all external dirt and water from the mechanism and retain lubricants inside the mechanism.

The arrangement of the embodiment of FIGS. 1 and 2 has advantages over that of the embodiment of FIG. 3. Thus:

1. Only one clamp plate 90 is required to hold the top bead 72 of the seal 70 under the crushing head 16. This means that the mass (weight) of parts moving with the head 16 is reduced with an equivalent reduction in inertia forces. Thus the bolting and clamping forces are all reduced and the vibration generated by the moving parts of the crusher 10 is reduced.
2. Since the springs 97 do not overcome inertia forces they are reduced in size and cost. Since they do not expand and compress with every gyration of the crushing head 16 they can be further reduced in size, weight and cost.
3. With the arrangement of FIG. 3, a broken spring 178 could be displaced by the relatively violent gyratory motion and the sharp broken ends may perforate the seal 170, allowing the entry of dirt and the escape of lubricant. In the embodiment of FIGS. 1 and 2, the risk of a spring 97 breakage is substantially reduced as a possibility because there is no cyclical compression and expansion of the springs. They receive initial compression and are thereafter stationary. Even if the extremely unlikely event of failure of a spring 97 did occur, then it is probable that the broken pieces would remain in place without damage to the seal 70.
4. The clamp plate 93 and friction material lining 95 are double squeezed between the crusher lower support frame 18*a* and pressure plate 96. This increases the frictional effect and permits the use of lighter springs.
5. Seal 70 transfers the frictional forces from the lower bead 73 to upper bead 72 to control rotation of head 16. Forces of any desired magnitude can be transferred by reinforcing the seal 70 with a suitable woven fabric, without a necessary reduction in flexibility.

However, despite these advantages of the embodiment of FIGS. 1 and 2 over that of FIG. 3, the latter embodiment is highly effective and with sound engineering practices, it can function in a comparable manner.

Finally, it is to be understood that various alterations, modifications and/or additions may be introduced into the constructions and arrangements of parts previously described without departing from the spirit or ambit of the invention.

We claim:

1. A gyratory crusher for crushing frangible or friable material, said crusher including a bowl which defines a chamber for receiving said material to be crushed and a discharge opening at the base thereof through which crushed material is able to discharge, a crushing head mounted in said bowl at an offset position with respect to a central axis of said bowl, and a drive assembly for driving said crushing head within said bowl for imparting gyratory motion to said head about a gyratory axis inclined with respect to and intersecting said central axis, whereby said frangible or friable material received into the chamber is subjected to crushing between an inner peripheral surface of said bowl and an outer peripheral surface of said head by the gyratory motion of the head, said crusher further including a system for restraining rotation of said head relative to said bowl and said gyratory axis, the system including:

(i) an annular resilient member disposed between an annular lower peripheral region of said head and an annular surface, of a fixed structure of said crusher, which is spaced from and substantially co-axial with said region;

(ii) securing means for securing a first edge of said resilient member to one of said annular region of said head and said annular surface of said fixed structure;

(iii) an annular band of friction material provided around a second edge of said resilient member; and (iv) biasing means for urging said friction band into frictional contact with the other one of said annular region of said head and said annular surface of said fixed structure.

2. A gyratory crusher according to claim 1, wherein said biasing means is operable to provide a sufficient said frictional contact to restrain said head from rotating relative to said bowl and gyratory axis while said head is gyrating in the absence in said chamber of material to be crushed, while allowing said head to rotate relative to said bowl and said gyratory axis, during a crushing operation, by slippage between said friction material and the other one of said annular region of said head and said annular surface of said fixed structure.

3. A gyratory crusher according to claim 1, wherein said securing means secures said first edge of said resilient member to said annular region of said head, with said biasing means urging said friction band into frictional contact with said annular surface of said fixed structure, such that, with any rotation of said head relative to said bowl and said gyratory axis, said resilient member is rotatable with said head by slippage between said friction material and said fixed structure, but with the action of said biasing means tending to retard the rotation.

4. A gyratory crusher according to claim 3, wherein said biasing means is mounted on said fixed structure.

5. A gyratory crusher according to claim 1, wherein said securing means secures said first edge of said resilient member to said annular surface of said fixed structure, with said biasing means urging said friction band into frictional contact with said annular region of said head, such that, with any rotation of said head, said securing means is restrained against rotation with said head by slippage between said friction material and the annular region of said head, but with the action of said biasing means tending to retard the rotation.

6. A gyratory crusher according to claim 5, wherein said biasing means is mounted between, and engages both of, said annular region and said annular surface.

7. A gyratory crusher according to claim 1, wherein said means for securing said first edge of said resilient member is selected from the group consisting of an annular plate and an annular series of arcuate plates, secured in relation to the one of said head and fixed structure so as to clamp said first edge securely to the one of said head and fixed structure.

8. A gyratory crusher according to claim 7, wherein said resilient member defines a bead which engages with said securing means and with the one of said head and fixed structure whereby said resilient member is restrained from being able to deform so as to pull away from said securing means.

9. A gyratory crusher according to claim 1, wherein said securing means is an assembly selected from the group consisting of an overlapping pair of annular plates and two overlapping annular series of arcuate plates, with said first edge gripped between said plates of said assembly, and the assembly is secured in relation to the one of said head and said fixed structure.

10. A gyratory crusher according to claim 7, wherein said securing means is adhered to said first edge of said resilient member by means selected from the group consisting of embedding means, adhesive means, and heat seal bonding means, with said first edge and said plate or series of plates being secured in relation to the one of said head and said fixed structure.

11. A gyratory crusher according to claim 1, wherein said resilient member is imperforate.

12. A gyratory crusher according to claim 1, wherein said resilient member is formed of a material which is suitable to function as the band of friction material required at its said second edge.

13. A gyratory crusher according to claim 1, wherein said band of friction material is selected from the group consisting of a member of a continuous annular form and an annular series of arcuate sections.

14. A gyratory crusher according to claim 1, wherein said resilient member and said band of friction material are of respective materials, and wherein said second edge of said resilient member is adhered to said friction band by one of bonding means and heat sealing means.

15. A gyratory crusher according to claim 1, wherein said friction band is part of an assembly including means for gripping said second edge of said resilient member and said friction band, with said friction band being secured to said gripping means.

16. A gyratory crusher according to claim 15, wherein said gripping means includes at least one of an annular plate and series of arcuate plates, which is adhered to said first edge of said resilient member by one of embedding means, adhesive means, and heat seal bonding means, with said first edge and said plate or series of plates being secured in relation to the one of said head and said fixed structure.

17. A gyratory crusher according to claim 1, wherein said biasing means is mounted on the one of said annular region of said head and said annular surface of said fixed member to which said friction member is to be urged into frictional contact.

18. A gyratory crusher according to claim 1, wherein said biasing means is mounted between said annular region and said annular surface, and subject to expansion and compression as said head gyrates.

19. A gyratory crusher according to claim 1, wherein said biasing means includes a plurality of compression springs disposed in an angularly spaced array.

20. A gyratory crusher according to claim 1, wherein said biasing means is selected from the group consisting of a spring of undulating annular form and a helical compression spring, which is substantially coaxial with said head and said annular surface of said fixed structure.

21. A gyratory crusher according to claim 20, wherein said biasing means is mounted between said band of friction material and a shoulder defined by the one of said head and said fixed structure to which said friction band is to be urged into frictional contact.

22. A gyratory crusher according to claim 21, wherein pressure transferring means selected from the group consisting of an annular pressure plate and an annular series of arcuate pressure plates is provided between said biasing means and said friction band, and wherein bias applied by said biasing means is applied to said friction band through said pressure transferring means.

* * * * *

UNITED STATES PATENT AND TRADEMARK OFFICE

CERTIFICATE OF CORRECTION

PATENT NO. : 5,775,607

DATED : July 7, 1998

INVENTOR(S) : Bayliss et al.

It is certified that error appears in the above-identified patent and that said Letters Patent is hereby corrected as shown below:

Col. 5 , line 58 - delete "1800" and substitute -- 180° --

Signed and Sealed this

Twenty-fifth Day of January, 2000

*Attest:*

*Attesting Officer*

*Acting Commissioner of Patents and Trademarks*